United States Patent [19]

Tong

[11] 4,116,381

[45] Sep. 26, 1978

[54] ELECTRICAL CONNECTION DEVICE FOR A TOY VEHICLE TRACK

[75] Inventor: Duncan Tong, Hong Kong, Hong Kong

[73] Assignee: Playart Ltd., Hong Kong, Hong Kong

[21] Appl. No.: 751,762

[22] Filed: Dec. 16, 1976

[30] Foreign Application Priority Data

Jul. 30, 1976 [GB] United Kingdom ..... 31929/76

[51] Int. Cl.[2] ..... A63H 19/30

[52] U.S. Cl. ..... 238/10 E; 46/1 K; 104/DIG. 1; 238/10 A

[58] Field of Search ..... 238/10 R, 10 A–10 F; 104/53, 60, 147 A, 149, DIG. 1; 46/1 K, 216

[56] References Cited

U.S. PATENT DOCUMENTS

| | | | |
|---|---|---|---|
| 1,726,670 | 9/1929 | Koerber | 104/DIG. 1 |
| 1,779,605 | 10/1930 | Koerber | 238/10 E |
| 2,040,665 | 5/1936 | McKeige | 238/10 E |
| 2,584,388 | 2/1952 | Husband | 238/10 B |
| 3,583,631 | 6/1971 | Christiansen | 238/10 E |

*Primary Examiner*—Albert J. Makay
*Assistant Examiner*—Carl Rowold
*Attorney, Agent, or Firm*—Townsend and Townsend

[57] ABSTRACT

An electrical connection device for a toy vehicle track constructed of a track base to which conductor rails are mounted. The connection device comprises a contact base, two or more contacts resilently mounted in or on the base, each contact being arranged and extending through a hole in the track base to engage electrically with the conductor rail of the track, and bias elements holding each contact in engagement with the track.

5 Claims, 3 Drawing Figures

ELECTRICAL CONNECTION DEVICE FOR A TOY VEHICLE TRACK

The present invention relates to electrical connections for toy vehicle tracks.

Toy vehicle tracks are normally provided with a connector rail with terminals to one side of the rail to which electrical connections to drive a toy vehicle are connected. These connector rails can only be fitted in certain parts of the track, and the lead from the connector rail to the vehicle controller necessarily limits the position of the controller. Thus the provision of connector rails makes the track layout inflexible, both from the necessity of fitting a special rail in a certain part of the track, and because of the limitation of locating the controller in a position relative to the connector rail.

It is an object of the invention to overcome these disadvantages and to provide a more flexible arrangement for connecting a vehicle controller to a toy vehicle track.

According to the invention there is provided an electrical connection device for a toy vehicle track comprising a contact base, two or more contacts resilently mounted in or on the base, each contact being arranged to engage electrically with a conductor rail forming part of the track, and means for holding each contact in engagement with the track.

Preferably the contacts are spaced apart the width of a pair of conductor rails. The means for holding each contact in engagement with the track may comprise one or more resilent members engageable with the side of the track, and a further part of the means for holding each contact in engagement with the track may comprise a lip portion, fixed to or integral with the contact base, and arranged to engage with the opposite side of the track to the, or each, resilent member.

Figure 1:
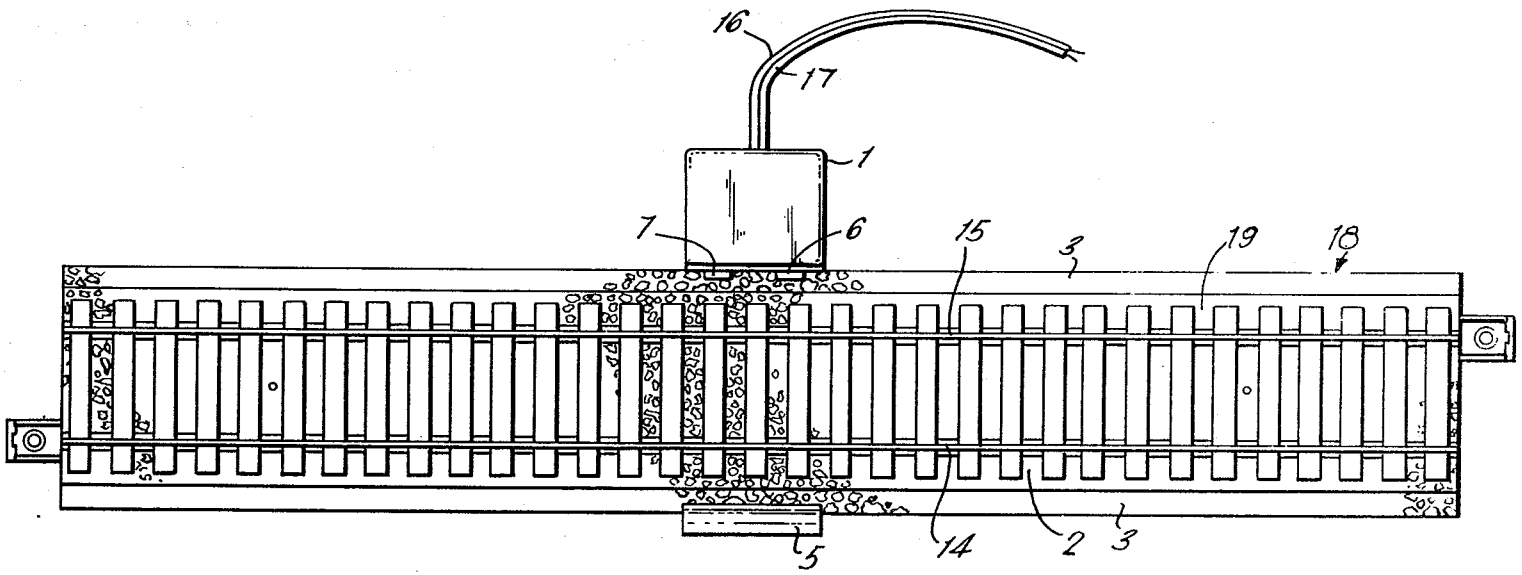
Figure 2:
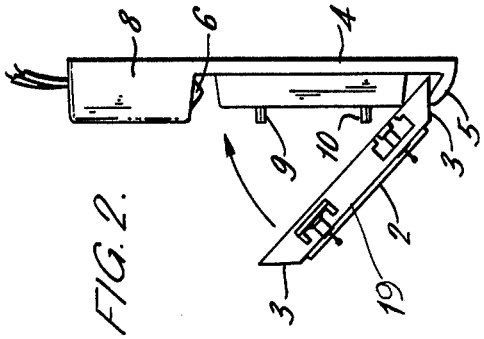
Figure 3:
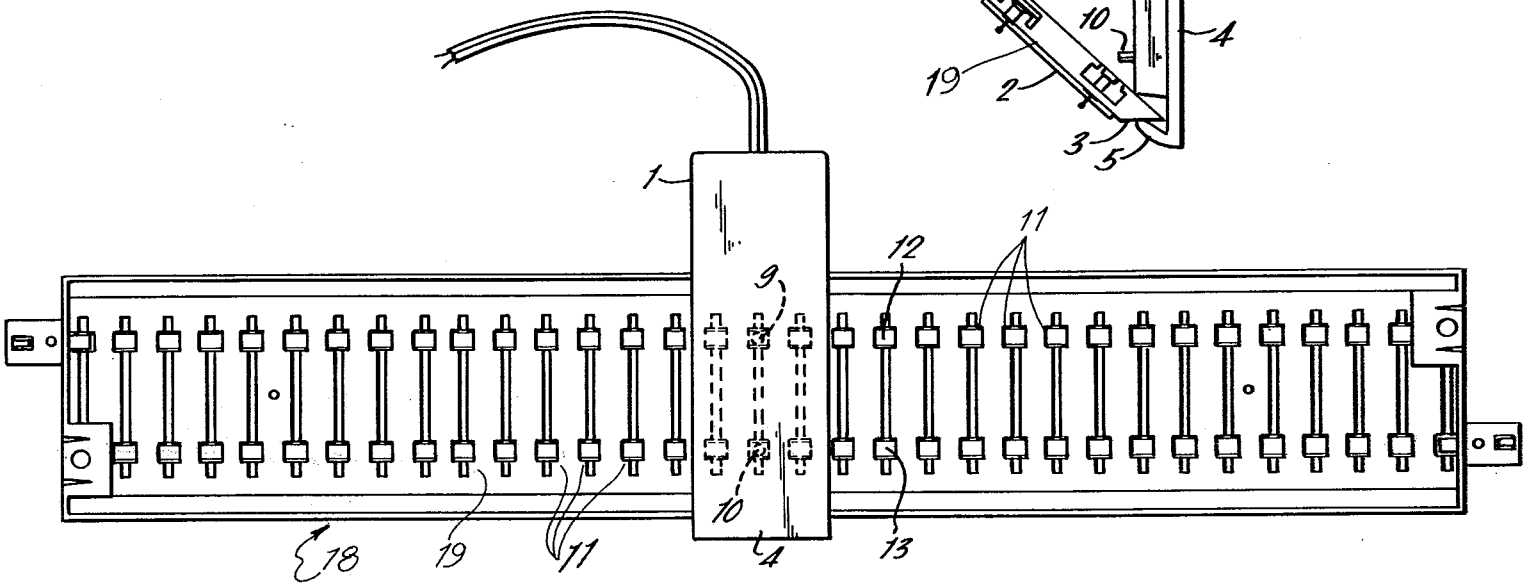

The invention will now be described with reference to the accompanying drawings, in which:

FIG. 1 is a plan view of a toy track to which is attached an electrical connection device according to the invention, FIG. 2 is an end view of a toy track being inserted into an electrical connection device as shown in FIG. 1, and FIG. 3 is an underside view of the track and connection device of FIG. 1.

FIG. 1 shows an electrical connection device 1 clipped on to a toy track 2. The toy track 2 has a continuous track base section 18 defined by a flat rail support plate 19 and chamfered sides 3 depending therefrom. The connection device has extending from its contact base 4 a lip portion 5 which engages with one chamfered side 3, whilst two resilently sprung engagement members 6 and 7 are mounted in a side block 8 forming a part of the contact base 4. The members 6 and 7 engage on the other chamfered side 3 of the track.

Also mounted on the contact base 4 are two resilently mounted contacts 9 and 10 movable in a direction perpendicular to the base 4 through holes 11 in support plate 19, to engage the undersides of the rails defined by flat-bottom faces 12 and 13 of the conductor rails 14 and 15 respectively. This may be seen in FIG. 3.

Electrical leads 16 and 17 are connected to the contacts 9 and 10 to conduct power from a controller to the conductor rails 14 and 15.

Although an electrical connection device is shown for connection to only two conductor rails, further contacts can be provided on an extended connection device for connecting to four or more conductor rails.

It will be appreciated that the connection device 1 can be connected at any point along the track provided there is room either side of the track for the connection device to be clipped on to the rail. Furthermore, providing the curvature of the rails is not too tight, the connection device can even be connected to a curved track section.

What we claim is:

1. A toy railway track comprising in combination a continuous base section defined by a flat support plate and a pair of longitudinally extending sides depending from the plate, the base section including laterally spaced apart hole sets in the support plate, each set being defined by a plurality of spaced apart, longitudinally extending holes; a pair of solid rails disposed on top of the support plate and having a flat bottom face overlying the holes of the respective hole sets; an electric contact device detachably mounted to the base section and having a plurality of contacts, each aligned with a hole of the respective hole sets and resiliently urged upwardly to extend through the holes and contact each of said rails, the contact device further including means engaging the sides of the base section for holding the device in position on the base section.

2. A toy railway track according to claim 1 wherein the engaging means comprises a lip portion attached to the contact device and engaging the sides of the base.

3. A toy railway track assembly according to claim 2 wherein the lip portion further includes means for resiliently engaging the sides.

4. A toy railway track according to claim 2 wherein the sides slope downwardly and outwardly with respect to the support plate, and wherein the lip portion includes a surface having a shape and configuration complementary to that of the sides.

5. A toy railway track for placement on a support surface comprising in combination a continuous base section defined by a flat support plate and a pair of longitudinally extending sides depending from the plate in a downward and outward direction so as to space the plate above the surface, the base section having a pair of solid rails mounted thereto in spaced apart relationship, the support plate including a plurality of serially arranged holes extending therethrough and positioned to be beneath the tracks, each rail having a downwardly facing, flat bottom face which overlies the holes; an electric contact device for connection of the rails to a source of electric power, the contact device including a contact base disposed beneath the base section and a pair of upwardly and inwardly projecting lip portions extending from the base and positioned and configured so as to engage the sides and thereby secure the device to the base section; the contact device further including a contact for each rail dimensioned to be extensible through the holes and means urging the contacts upwardly through the holes into contact with the respective rails; and means for resiliently engaging the lip portions with the base section sides.

* * * * *